US006889894B2

(12) United States Patent
Yong

(10) Patent No.: US 6,889,894 B2
(45) Date of Patent: May 10, 2005

(54) MULTI-COMPARTMENT MAILBOXES

(75) Inventor: Teng Long Yong, Singapore (SG)

(73) Assignees: Boon Falt Yong, Singapore (SG); Boon Meng Yong, Singapore (SG)

( * ) Notice: Subject to any disclaimer, the term of this patent is extended or adjusted under 35 U.S.C. 154(b) by 73 days.

(21) Appl. No.: 10/311,126

(22) PCT Filed: Jun. 13, 2001

(86) PCT No.: PCT/SG01/00120

§ 371 (c)(1),
(2), (4) Date: Dec. 13, 2002

(87) PCT Pub. No.: WO01/95772

PCT Pub. Date: Dec. 20, 2001

(65) Prior Publication Data

US 2003/0150906 A1 Aug. 14, 2003

(30) Foreign Application Priority Data

Jun. 13, 2000 (SG) ..... 200003285
Aug. 24, 2000 (SG) ..... 200004806

(51) Int. Cl.[7] ..... B65D 91/00

(52) U.S. Cl. ..... 232/25; 211/10; 292/36; 292/158

(58) Field of Search ..... 232/24, 25, 45; 211/10; 292/8, 35, 36, 158

(56) References Cited

U.S. PATENT DOCUMENTS 1,642,533 A * 9/1927 Beer ..... 232/25
1,719,541 A * 7/1929 Gaffner et al. ..... 232/24
2,486,460 A 11/1949 Bonenberger
5,794,844 A * 8/1998 Jenkins ..... 232/25
5,820,019 A * 10/1998 Spitale ..... 232/25

FOREIGN PATENT DOCUMENTS

| | | |
|---|---|---|
| DE | 131 682 C | 1/1901 |
| EP | 0 278 704 | 8/1988 |
| EP | 0458689 A1 | 11/1991 |
| FR | 2599954 A1 | 12/1987 |
| FR | 2 770 117 A | 4/1999 |
| GB | 297 215 | 9/1928 |
| GB | 2 151 293 A | 7/1985 |
| GB | 2 289 500 | 11/1995 |

OTHER PUBLICATIONS

Austrian Patent Office Search Report completed Jan. 18, 2001.
PCT International Search Report of Jun. 4, 2002.

* cited by examiner

*Primary Examiner*—William L. Miller
(74) *Attorney, Agent, or Firm*—Greenberg Traurig, LLP; Christopher Darrow, Esq.; Eglia Nair Flores

(57) ABSTRACT

A multi-compartment facility having a master door which can be opened by use of a master key and, when opened, admits substantially unrestricted access to all of the mailbox compartments, the master door incorporating a plurality of pivotally-mounted, sub-doors arranged to register each with a different one of the compartments and the sub-doors being individually lockable and openable only by assigned key holders. A manually operable control determines the condition of the flaps and employs a gear and rack system which moves a cam to longitudinally displace hinge rods for the sub doors, flap locking members being carried by the hinge rods and either preventing opening of the flaps or permittting them to open depending on the displacement condition of the hinge rods. In a modified arrangement, the flaps can be selectively and individually rendered non-lockable whereby the users can opt to receive junk mail and other deliverables.

18 Claims, 11 Drawing Sheets

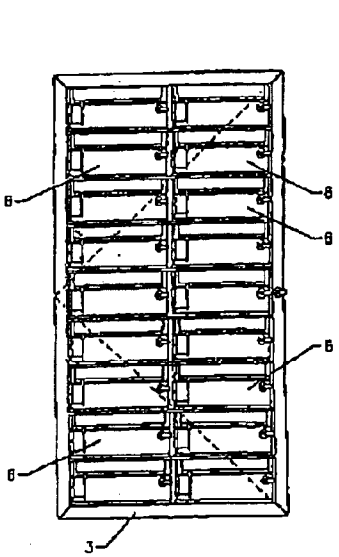
FIG 1D
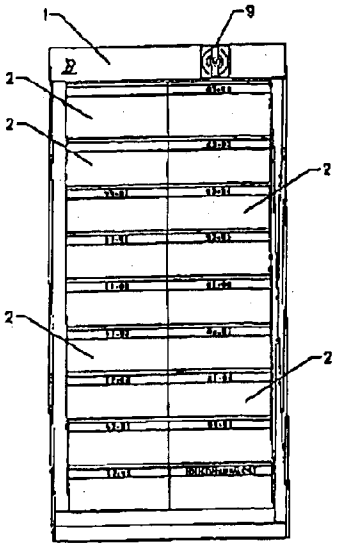
FIG 1C
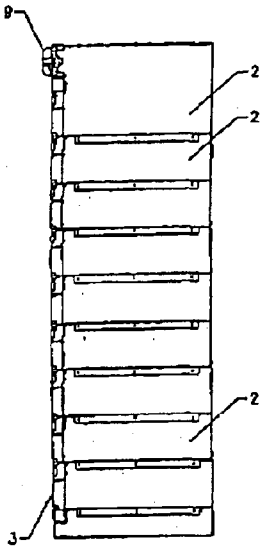
FIG 1B
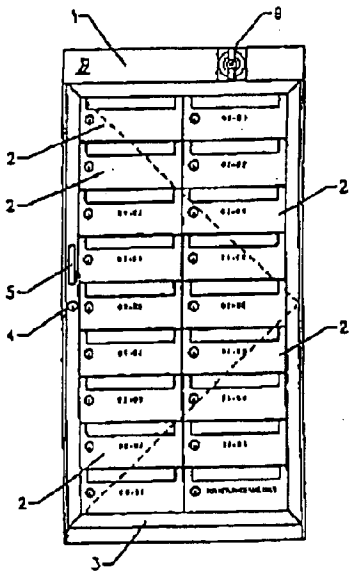
FIG 1A
FIG 1
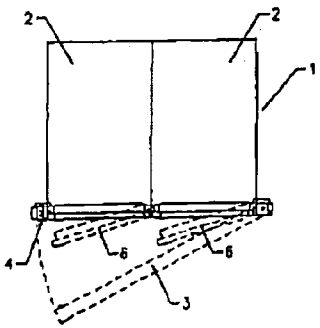
FIG 1E

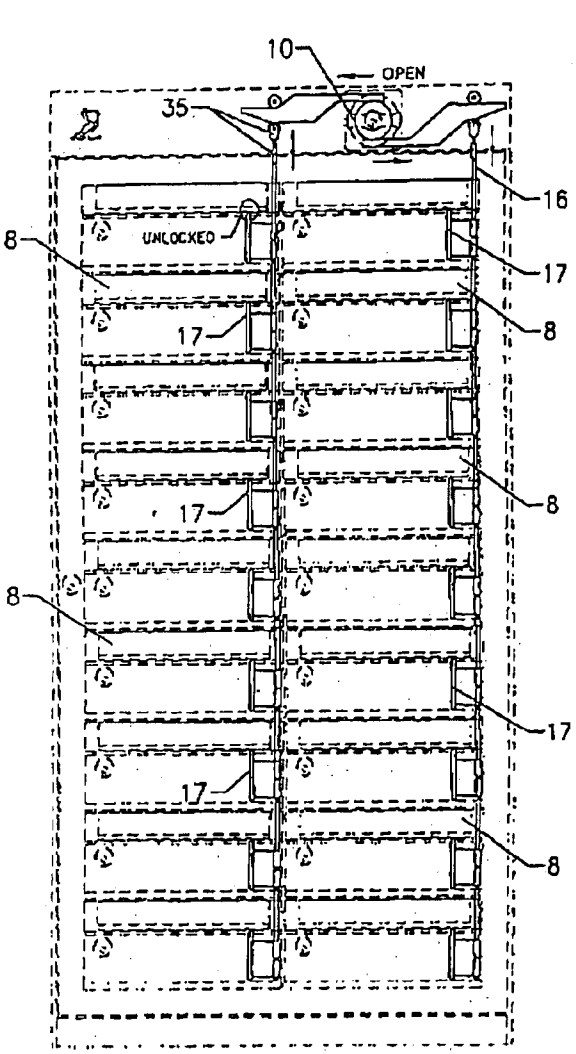
FIG 3B
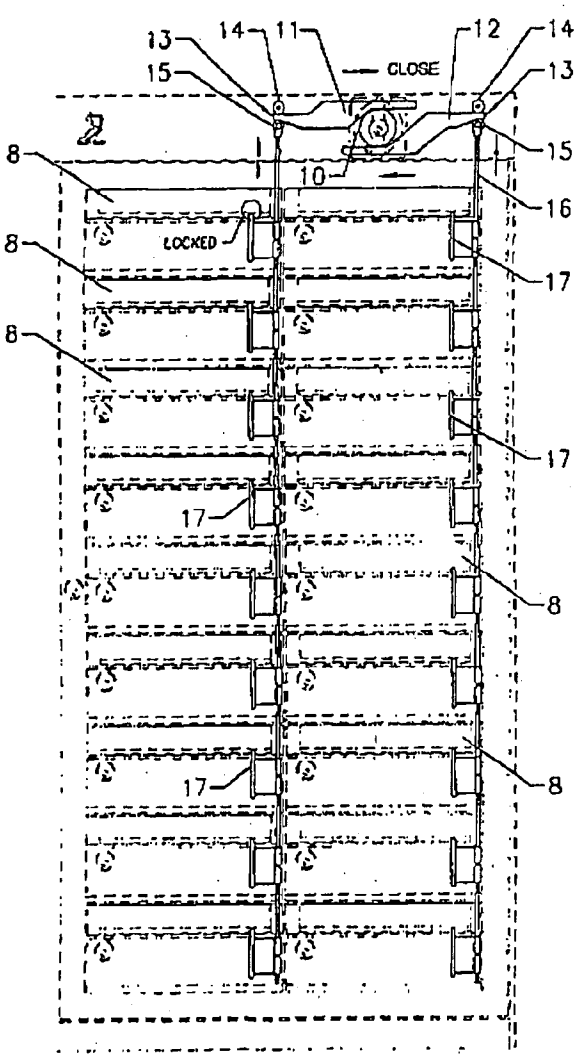
FIG 3A
FIG 3

FIG 4B & 4C
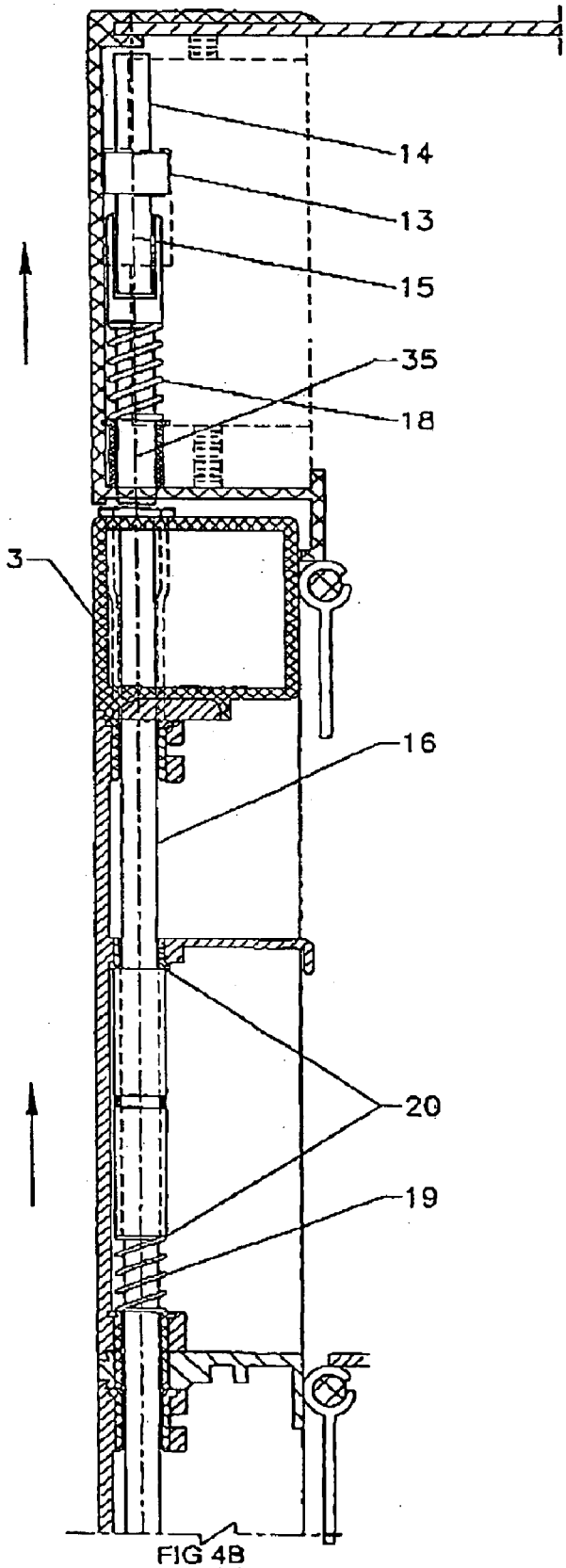
FIG 4B
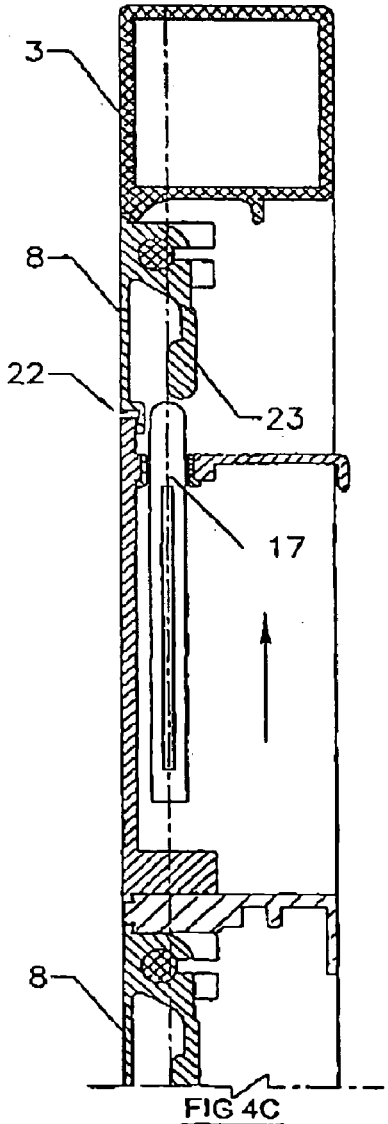
FIG 4C

FIG 5B & 5C
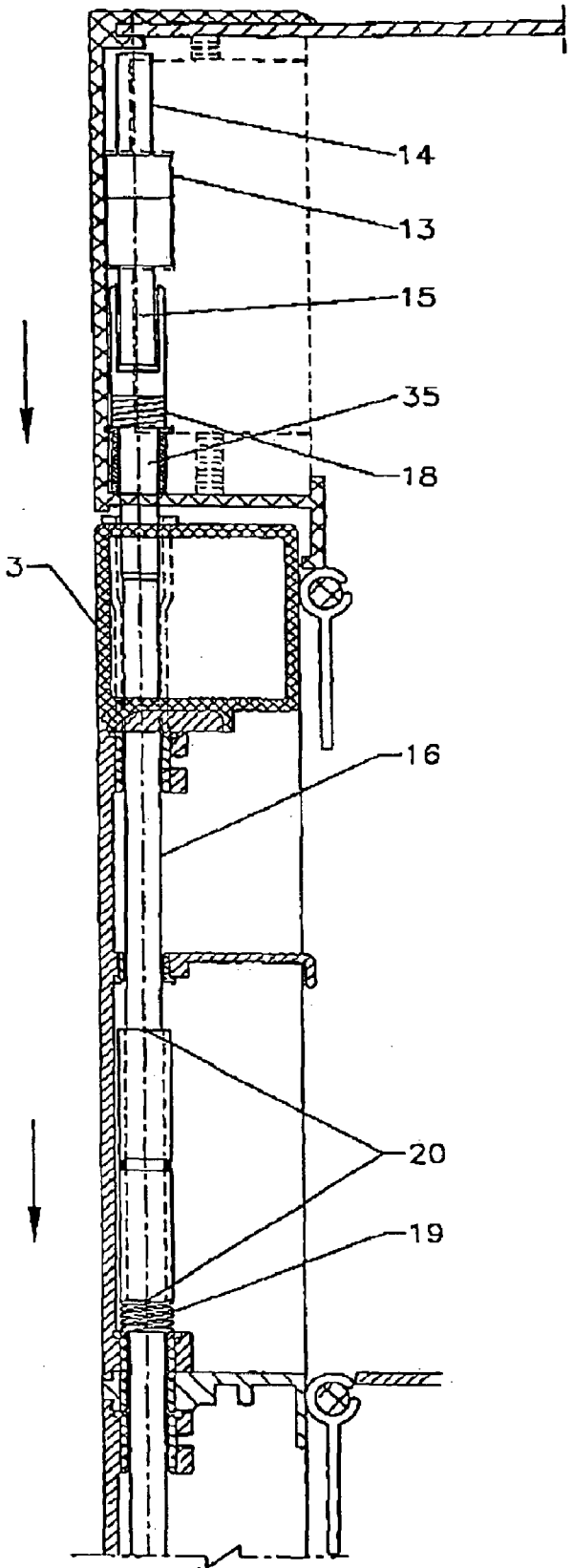
FIG 5B
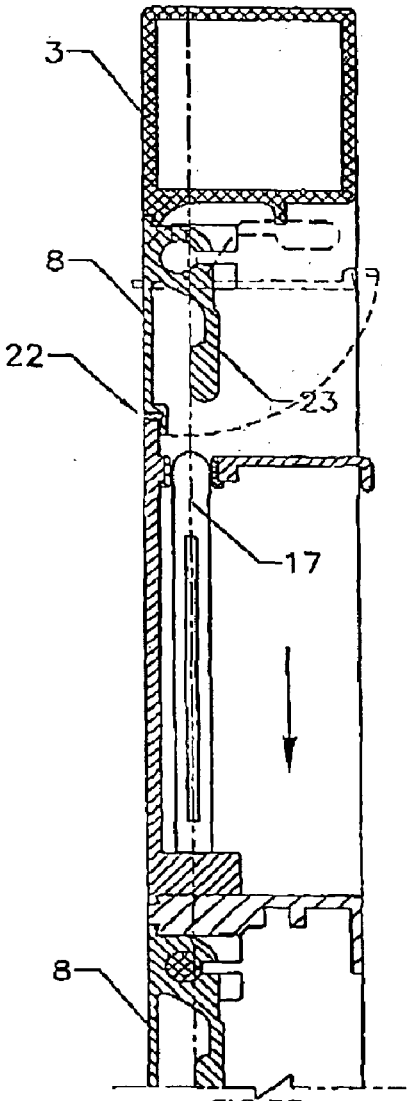
FIG 5C

MULTI-COMPARTMENT MAILBOXES

FIELD OF THE INVENTION

This invention concerns improvement relating to multi-compartment mailboxes such as are employed in multiple occupancy apartments and office blocks and wherein each compartment of the mailbox has a lockable door operable with a key individual to that particular compartment only. Such multi-compartment mailboxes enable mail to be delivered to a single location but separately for each occupier and with security that, barring mistakes by the mail delivering operative, each occupier will receive and have access to only his own mail.

BACKGROUND OF THE INVENTION

In a disclosure as early as 1928, the prior art GB 297 215 teaches of a multi-compartment repository for letter parcels and the like where a main door has incorporated therein small doors arranged to provide access to individual compartments. On each of these small doors is provided an insertion clot with a movable flap on the outside to the door as cover for the slot. The slots are further provided with arresting bars or steps to prevent unauthorised retrieval of delivered mail from the compartments. However, this prior art arrangement does not provide for stopping of delivery of junk mail.

Multi-compartment mailboxes are susceptible to misuse by persons delivering unwanted junk mail and measures have been proposed in an attempt to combat this. In particular, it has been proposed to provide an arrangement whereby the mail delivery flaps of the compartments are lockable all together and the legitimate mail delivery operative, hereinafter called the postman, has a master key which enables the mail delivery flaps to be unlocked all together so that legitimate mail can be delivered.

Such an anti-junk mail system is disclosed in GB-A-2289500 and has a mail delivery flap and a lockable mail collection door associated with each compartment of a multi-compartmented array, the lockable mail collection doors being operable by their respective keyholders, different occupants of the building for example, and there being a matrix array of orthogonal bars which can be moved in dependence upon the operation of a master key between positions where the horizontal bars obstruct the mail delivery flaps and thus prevent them from being opened and where the matrix array is moved bodily and permits the delivery flaps to be opened. The individual occupants of an apartment or office block are given keys for their own mailboxes and none other and can collect mail from their assigned mailboxes only, and the postman has the master key which enables the posting flaps to be collectively unlocked for delivery of mail items.

A problem that arises with the system of GB-A-2289500 is that the mail delivery flaps limit the size of package which can be delivered. Larger packages which will not fit through the delivery flaps may be left half in and half out of the respective flap or may be left on top of the mailbox array and in either case are not secure. Alternatively the postman has to hand carry the package to the respective apartment or office which obviates the advantages of providing a multi-compartment mail box in the first place.

OBJECTS AND SUMMARY OF THE INVENTION

In accordance with the present invention, a multi-compartment mailbox a has a master door which can be opened by use of a master key and, when opened, admits substantially unrestricted access to all of the mailbox compartments, the master door incorporating a plurality of sub-doors arranged to register each with a different one of the compartments and the sub-doors being individually lockable and being openable only by assigned key holders.

It is to be noted that the system of GB-A-2289500 contemplates only a two way access to the mailboxes for the postman and each occupier. However, there is a need at times for an additional access by a third party such as a building supervisor or council officials who may wish to deliver mail without using the postal system, such that even if the postman has locked his or her access to the mailbox, the third party may still deliver mail. In such cases, there would be a three-way access to the mailboxes.

In use of such an arrangement, a postman wishing to deliver mail including large packages has only to open the master door. Thereafter, the individual building occupants can open their respective sub-doors by use of their individually assigned keys to collect their mail, but cannot access anybody else's mailbox.

Clearly, not every mail delivery will necessarily include packages of such a size as would not fit a conventionally sized mail delivery slot. To accommodate this possibility, the present invention further contemplates the provision of a mail delivery flap associated with each compartment with all of the mail delivery flaps being commonly lockable to prevent posting of junk mail. For example, each of the sub-doors abovementioned might be provided with such a lockable mail delivery opening. For locking and unlocking such mail delivery openings, a common locking arrangement will be provided which may be operated by the same master key as is employed for operating the master door or might use a different key.

In accordance with a preferred embodiment of the invention which is described in detail hereinafter, an arrangement for collectively locking and unlocking mail delivery flaps provided on the compartment sub-doors makes use of vertical rods extending through the array of compartments and the same vertical rods are utilised for hingedly mounting the sub-doors of the mailing compartments. The delivery flaps are horizontally hinged with respect to the sub-doors and the vertical rods are arranged so as to be vertically movable under control of a manual operating knob which can be locked so as to be rendered inoperable until unlocked. Attached to the vertical rods at plural locations are locking elements which, in one position of the vertically displaceable rods engage with the mail delivery flaps so as to lock them in closed position and, in another position of the rods to which the rods can be moved by operation of the operating knob, are disengaged from the mail delivery flaps which then can be opened for delivery of mail.

In accordance with a particularly convenient arrangement the manual operating knob is rotatable, once unlocked, and has attached thereto a gear wheel which engages a rack so that upon rotation of the knob and correspondingly of the gear wheel the rack is linearly displaced. A cam surface of the rack engages an actuator aligned with an adjoining end portion of one of the aforementioned vertical rods so that displacement of the rack causes a corresponding displacement of the actuator and thereby of the respective rod and, in turn, determines the condition, locked or unlocked, of the mail delivery flaps.

The above and further features of the present invention are set forth in the appended claims, and together with the advantages thereof, will best be appreciated from consideration of the following detailed description of an exemplary embodiment which is illustrated in the accompanying drawings.

DESCRIPTION OF THE DRAWINGS

FIGS. 1A through 1E show, respectively, a front elevation view of the embodiment with the master door closed, a typical side sectional view, a front elevation (inside) view with the master door open, an elevation view of the rear of the master door and a plan view partly in phantom;

FIGS. 3A and 3B show the centralised locking arrangement of FIG. 2 in, respectively, locked and unlocked condition;

FIGS. 4A through 4D show the centralised locking arrangement in enlarged views and in closed (locked) condition, as in FIG. 3A, FIG. 4A being a detailed elevation view and FIGS. 4B, 4C and 4D being respectively, sectional views on the lines I . . . I, II . . . II and III . . . III shown in FIG. 4A;

FIGS. 5A through 5D are views corresponding respectively to the views of FIGS. 4A through 4D with the centralised locking arrangement in opened (unlocked) condition;

DETAILED DESCRIPTION OF THE EMBODIMENTS

Figure 2:
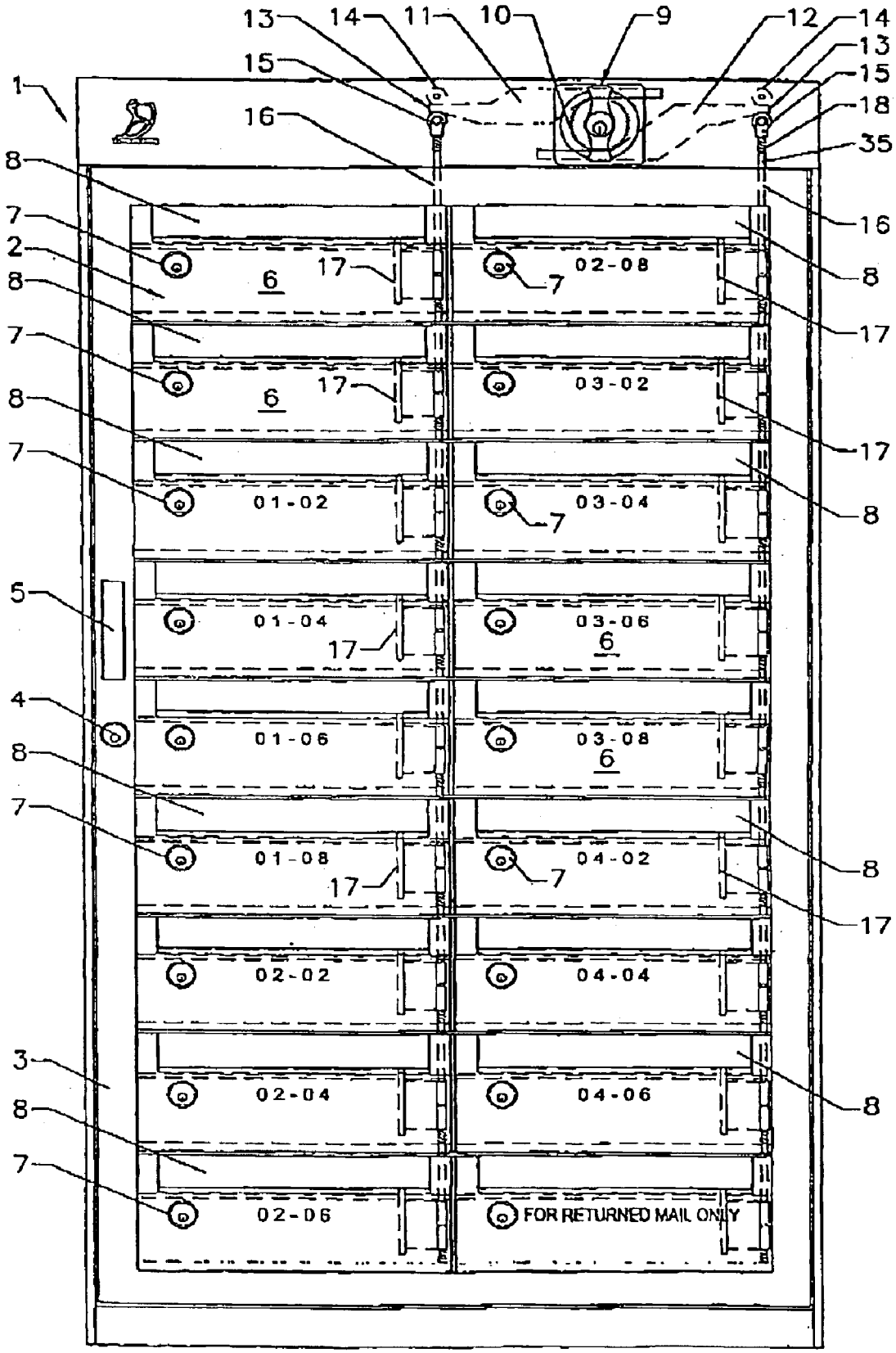
FIG. 2 shows an enlarged front elevation view, similar to FIG. 1A, which also shows in phantom the centralised locking arrangement for the mail delivery flaps.

Referring to FIG. 1A and the corresponding enlarged views of FIG. 2, the multi-compartment mail box 1 of the embodiment has two columns each of nine compartments 2. A master door 3 is hinged on the right hand side of FIGS. 1A and 2 and has an associated key operated master lock 4 and a pull handle 5. When the master door 3 is opened, as shown in FIG. 1C, the inner compartments 2 of the mailbox are fully accessible for placement of packages up to substantially the full size of the compartment. When the master door 3 is closed and locked, access to the compartments 2 is enabled by provision of sub-doors 6 individually associated with and in registry with respective ones of the compartments 2, the sub-doors 6 being mounted in the master door 3 so that when the master door is unlocked and opened, all the sub-doors 6 move with it. See in this connection FIG. 1E which shows the master door 3 in closed condition with the sub-doors 6 in open condition in phantom. The sub-doors 6 each incorporate a lock 7 openable with a key which will not open any of the other sub-door locks and also each has a mail delivery flap 8 and, as described below, the plural mail delivery flaps 8 in the mailbox 1 are all commonly lockable and unlockable by a common arrangement including a manually operable knob handle 9 which, as can be seen from FIGS. 1A and 2, is provided on the front of the mailbox 1.

FIG. 2 shows the basic principles of the mail delivery flap common locking and unlocking arrangement. The control knob 9 is a lockable and unlockable rotary knob which, when unlocked enables a gear wheel 10 to be turned. The gear wheel 10 meshes with two rack members 11 and 12 so that when the gear wheel is rotated the rack members translate horizontally. End portions 13 of respective rack members 11, 12 are wedge-shaped and locate between a roller 14 fixed to the mailbox chassis and a roller 15 attached to the upper end of a spring biased actuator 35 which is aligned with a spring biased vertical rod 16 which extends downwards throughout the extent of the master door 3 and provides hinged mounting for respective ones of sub-doors 6. In the embodiment shown, the vertical rod 16 associated with rack member 11 serves to mount the sub-doors 6 of one column of mailbox compartments, and the vertical rod 16 associated with the other rack member 12 serves to mount the sub-doors 6 of the other column of mailbox compartments.

Rotation of the knob handle 9 and the gear wheel 10 causes horizontal translation of the wedge-shaped end portions 13 of the rack members 11, 12 between the rollers 14 and 15 which in turn causes the actuators 35 to be displaced so as to displace the vertical rods 16. Affixed to the rods 16 are locking members 17 which, as shown schematically in FIGS. 3A and 3B, interfere with the opening movement of respective ones of the mail delivery flaps 8 when the rods 16 are in their uppermost positions (FIG. 3A) and prevent opening of the respective flaps, and when the rods 16 are displaced downwardly (FIG. 3B) move out of engagement with the flaps 8 so as to permit them to be opened.

Figures 4A, 4D:
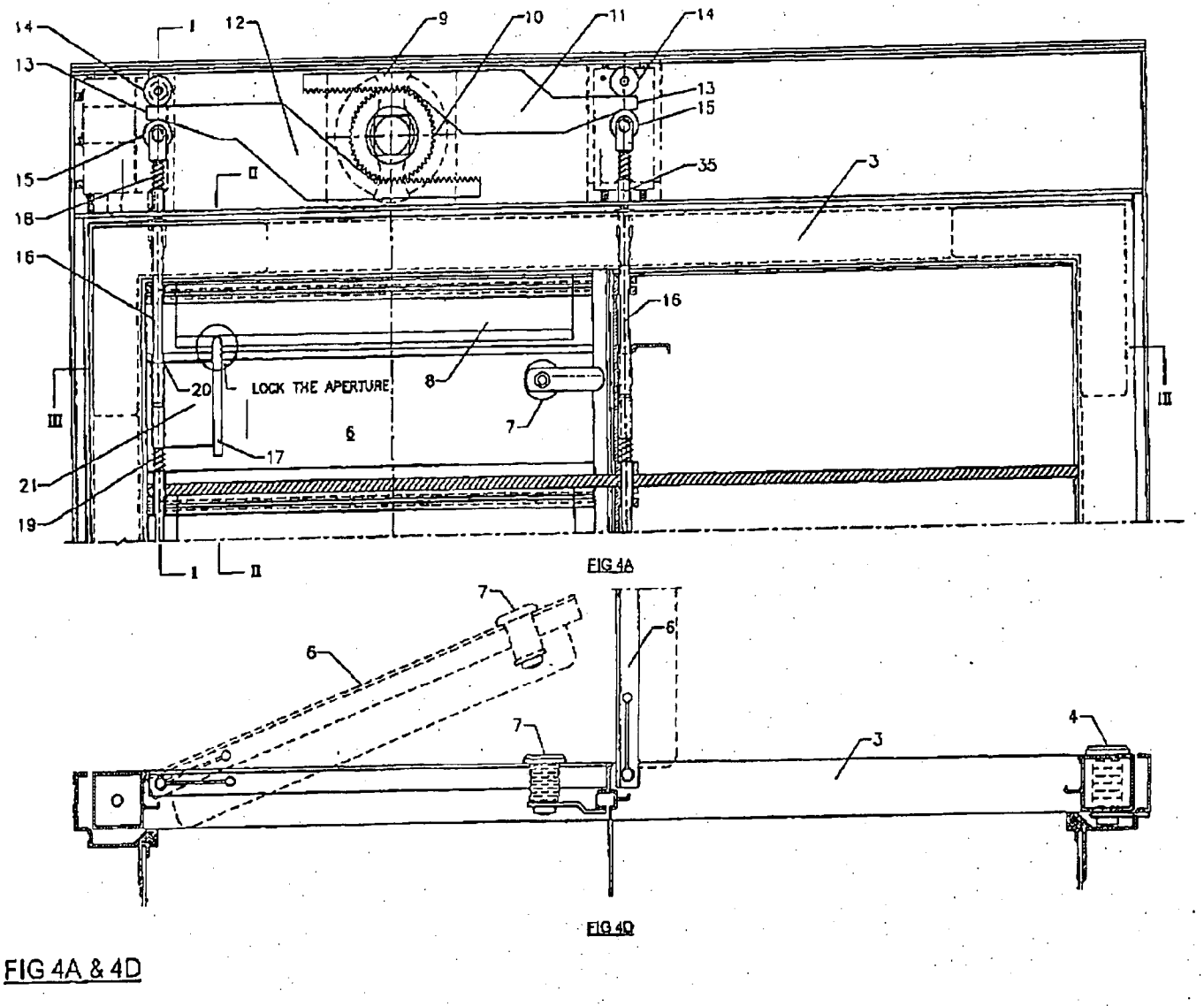

FIGS. 4A through 4D show the centralized mail delivery flap locking arrangement in full detail in its closed (locked) condition. Referring first to FIG. 4A which shows the locking arrangement as viewed from the inside of the mailbox, namely from the back of the master door, the manually operable knob handle 9 can be seen in phantom and its attached gear wheel 10 engaging the racks 11, 12 can be seen in full line. The wedge-shaped ends 13 of the racks engage as shown between the rollers 14 and 15 which are affixed, respectively to the mailbox chassis and to the upper ends of the spring biased actuators 35 so that turning of the knob handle 9 in a direction such as to advance the racks 11,12 between the rollers 14,15 causes the actuators 35 to project through openings formed in the underside of the top of the master door frame. With the master door closed the lower ends of the actuators 35 project into openings provided in the top edge of the master door and engage and depress against spring bias the upper ends of the vertical rods 16. When the knob handle 9 is subsequently returned to its original position, the racks 11,12 withdraw from between the rollers 14,15 which permits the actuators 35 to resile upwards and, in turn, permits the rods 16 to resile upwards. Note that the rods 16 are always contained within the fabric of the master door, their extent of permitted movement being limited, and that the master door cannot be opened if the actuators 35 are depressed. To ensure that the knob handle 9 is not left in an unlocked position accidentally thereby preventing the master door from being opened, it is provided that the key to operate the knob handle 9 cannot be withdrawn from the lock if it is in an open position.

The vertical rods 16 extend downwards through respective ones of the two columns of mailbox sub-doors 6 and, as previously mentioned, provide for the hinged mounting of the sub-doors. The rods 16 are spring biased upwardly by means of springs 18, 19 provided at appropriate locations and abutments 20 provided on the rods cooperate with portions of the frame of master door 3 (see FIG. 4B) to determine the range of upwards and downwards movement permitted to the rods. Affixed to the rods 16 at the locations of the abutments 20 are plates 21 which carry at their edge opposite to the abutment respective ones of the locking members 17 which are in the form of elongate rod-like fingers extending parallel to the vertical rods 16.

The mail delivery flaps 8 can be seen in cross-section in FIG. 4C and are horizontally pivoted with respect to respective ones of the sub-doors 6 along their upper edges. A lip 22 at the lower edges of the mail delivery flaps 8 interferes with the front face of the sub-doors 6 to ensure that the flaps can only pivot inwardly, and a counterweight 23 ensures that the flaps return to closed condition once an item of mail has been inserted.

Figures 5A, 5D:
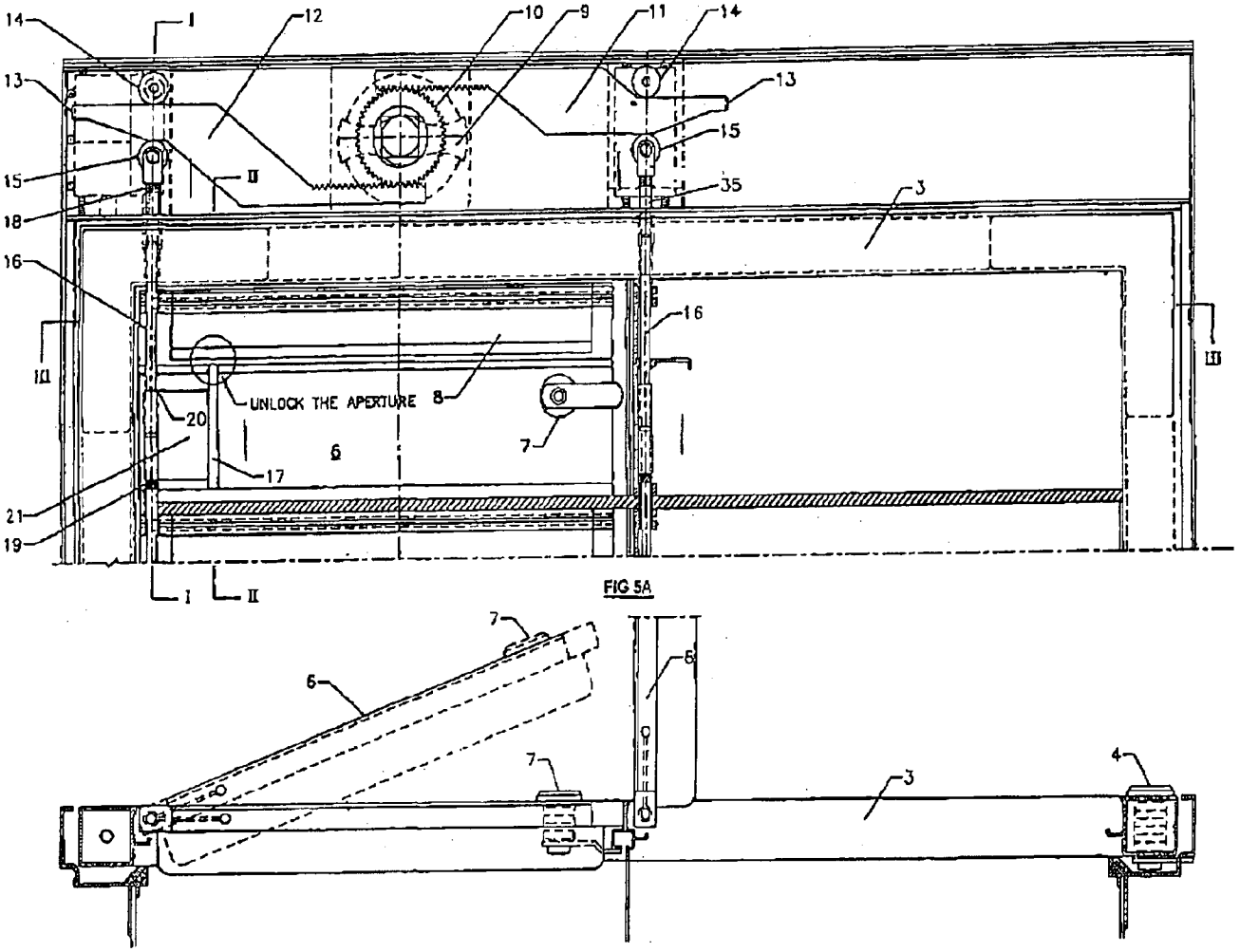

When the mail delivery flaps locking arrangement is in the condition shown in FIG. 4A, the rods 16 are in their uppermost positions and the locking fingers 17 are so positioned that their upper ends locate behind the flaps 8 (see FIG. 4C) to prevent them being opened. When, as shown in FIG. 5A, the knob handle 9 is turned to unlock the flaps 8 by translation of the racks 11, 12 and corresponding downwards movement of the actuators 35 and thus of the rods 16, the upper ends of the locking fingers 17 move clear of the flaps (see FIG. 5C) so that the flaps 8 can be opened. Regardless of the condition of the flaps 8, that is to say regardless of whether they are collectively locked or collectively unlocked, the individual sub-doors 6 can still be opened.

Figure 6B:
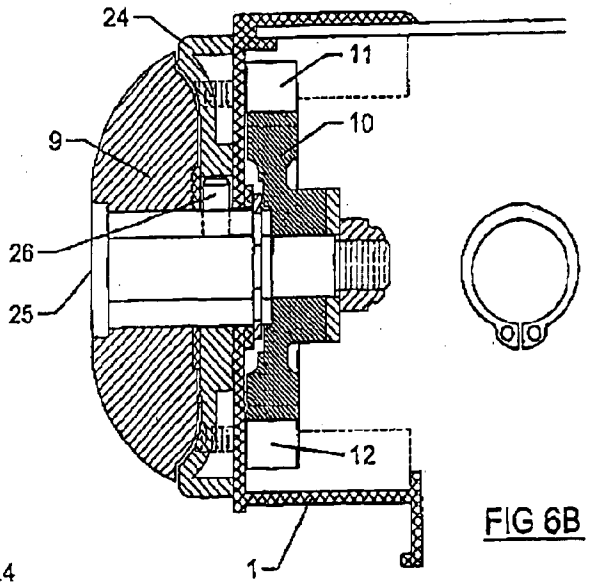
FIGS. 6A through 6C are, respectively, front elevation, cross-sectional side elevation and exploded views of the locking control knob employed in the centralised mail delivery flap locking arrangement.
Figure 6A:
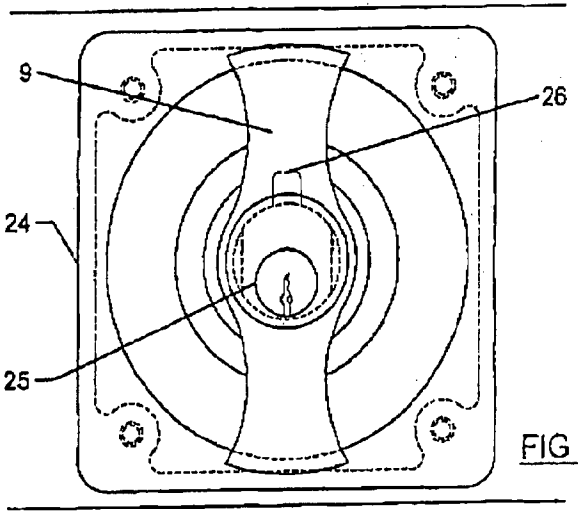
Figure 6C:
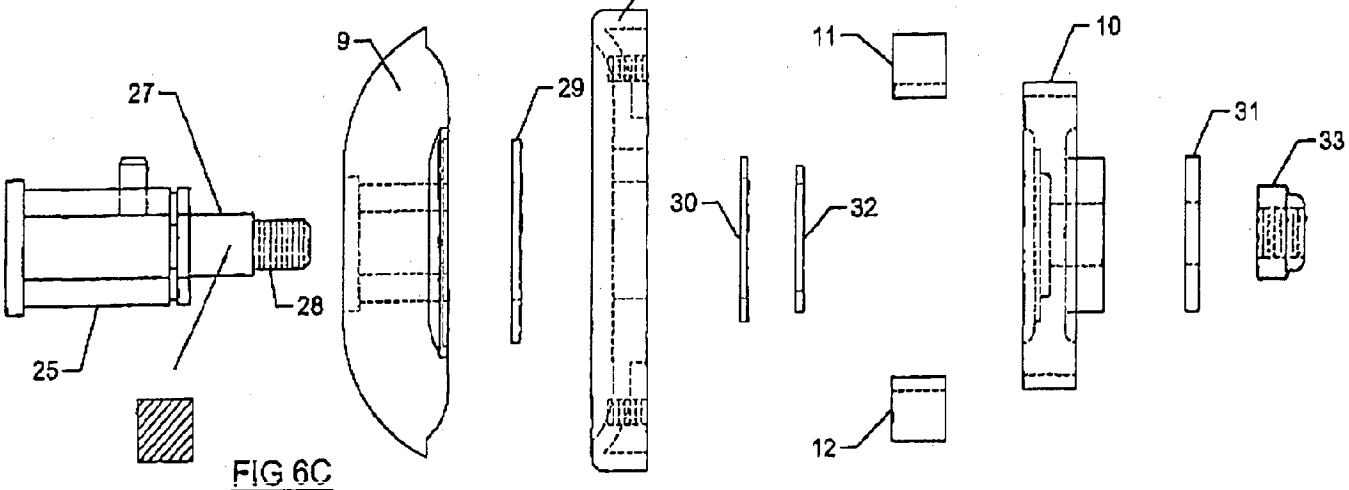

FIGS. 6A, 6B and 6C show the form of the manual control that is associated with the above described centralised flap locking arrangement, and illustrate how such control can itself be locked so as to be inoperable and unlocked for operation. The control comprises a knob handle 9 as above-mentioned which is rotatable relative to a knob base 24 in dependence upon the condition of a lock 25 which is bonded with the knob handle 9. When the control lock 25 is unlocked, the knob handle 9 can be rotated, and when the control lock 25 is locked a part 26 engages with the base 24 to prevent the knob handle 9 being turned. The control lock 25 has a rectangular section shank 27 with a screw-threaded end portion 28 and, as shown in FIG. 6B, this enables the gear wheel 10 to be affixed to the knob handle 9 for rotation therewith when the knob handle is unlocked and turned. FIG. 6C shows the parts of the flap locking arrangement in exploded view, reference numerals 29 and 30 in this view designating Nylon™ washers, reference number 31 designating an end washer, reference number 32 designating a circlip serving to retain the knob handle 9 and control lock 25 to the mailbox chassis 1, and reference numeral 33 designating a screw threaded fastening nut. As a precautionary measure to avoid the lock being left in an unlocked state unintentionally, it is provided that the key used with the control lock 25 cannot be withdrawn if the control lock 25 is not in a locked position. The user would therefore be alerted to the fact that the lock is still open as he or she would not be able to withdraw the key.

The arrangement thus described provides, amongst other features, a master door which the postman can open in order to deliver packages which are too large to fit the mail delivery flaps that are provided in the individual sub-doors. The mail delivery flaps can be accessed for delivery of small mail items and to guard against insertion of junk mail into the mailboxes, the mail delivery flaps can be commonly locked and unlocked. The same key as locks and unlocks the master door could be used to lock and unlock the mail delivery flaps, but it is preferred to provide different keys for this purpose since keys for locking and unlocking the mail delivery flaps may advantageously be given to other persons, such as the building supervisor or to council officials for example, who desirably should not have a key to the master door.

It is to be noted that the system of GB-A-2289500 contemplates only two way access to the mailboxes for the postman and each occupier. However, there is a need at times for an additional access by a third party such as a building supervisor or council officials who may wish to deliver mail without using the postal system, such that even if the postman has locked his or her access to the mailbox, the third party may still deliver mail. The above-described embodiment meets this need by providing three-way access to the mailboxes.

Figures 7A, 7B, 7C, 7D:
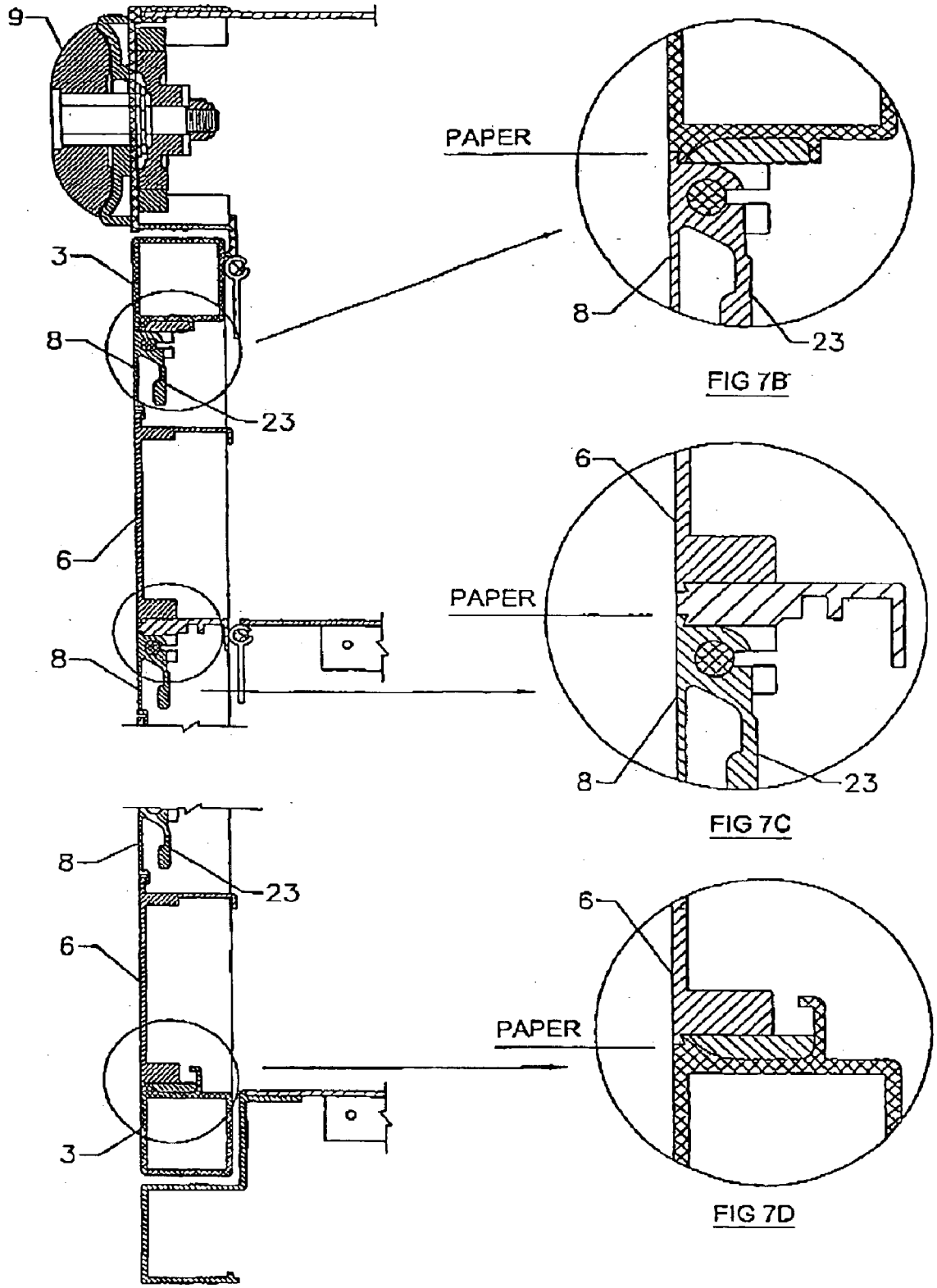
FIGS. 7A through 7D show, respectively, a detailed sectional side elevation view of the master door corresponding to the left hand side of FIG. 1B, and enlarged sectional views showing anti-junk mail features.

Referring now to FIGS. 7A, 7B, 7C and 7D, these show features built into the mailbox structure to ensure that thin sheets of paper cannot be slipped into the mailboxes when the mail delivery flaps are locked. FIG. 7A shows a sectional view through a master door which closely shows details of the mail delivery flaps 8 and of the sub-doors 6 and FIGS. 7B, 7C and 7D are enlarged showing of details. As can be seen from FIGS. 7B, 7C and 7D the upper edges of the mail delivery flaps 8 engage with complementarily shaped edges of the sub-doors 6 with a convoluted section and the same is the case for the edges of the sub-doors where they fit into the frame of the master door 3 and for the master door where it fits into its frame. These convoluted profiles effectively prevent the insertion of thin sheets into the mailboxes.

Referring now to FIGS. 8A and 8B and FIGS. 9A and 9B, these show a modification of the above-described embodiment which enables the mail delivery flaps 8 of the individual compartments to be selectively left unlocked if the user of the respective compartment is happy to receive junk mail and other materials. Comparing the arrangement shown to the arrangement in FIG. 4A, it can be seen that the locking finger 17 of FIG. 4A is modified so as to be selectively adjustable within a tubular edge portion of the plate 21 much in the manner of a door bolt. The tubular edge portion is designated 210 in FIGS. 8A and 8B and in FIGS. 9A and 9B, the adjustable locking finger is designated 170 and has attached thereto an operating member 171 which can move in an L-shaped opening 211 in the side wall of the tubular portion 210.

Figure 8B:
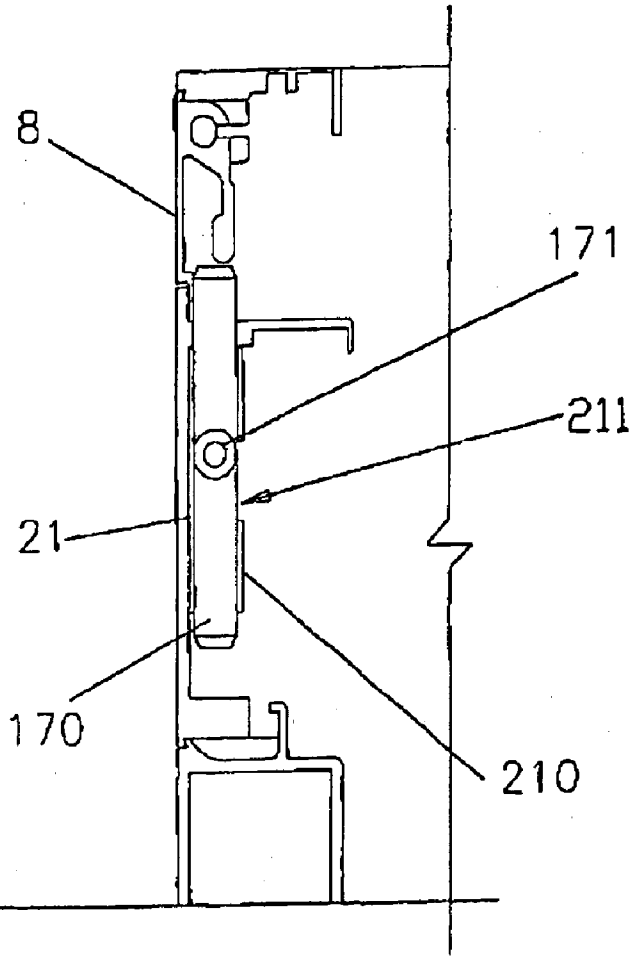
FIGS. 8A and 8B are partial front and side elevation views showing a modification of the mail delivery flap locking member of the abovementioned embodiment, the modification enabling the mail delivery flap to the left open at the will of the respective mailbox compartment user and the modified locking member being shown in operable condition in FIGS. 8A and 8B.
Figure 8A:
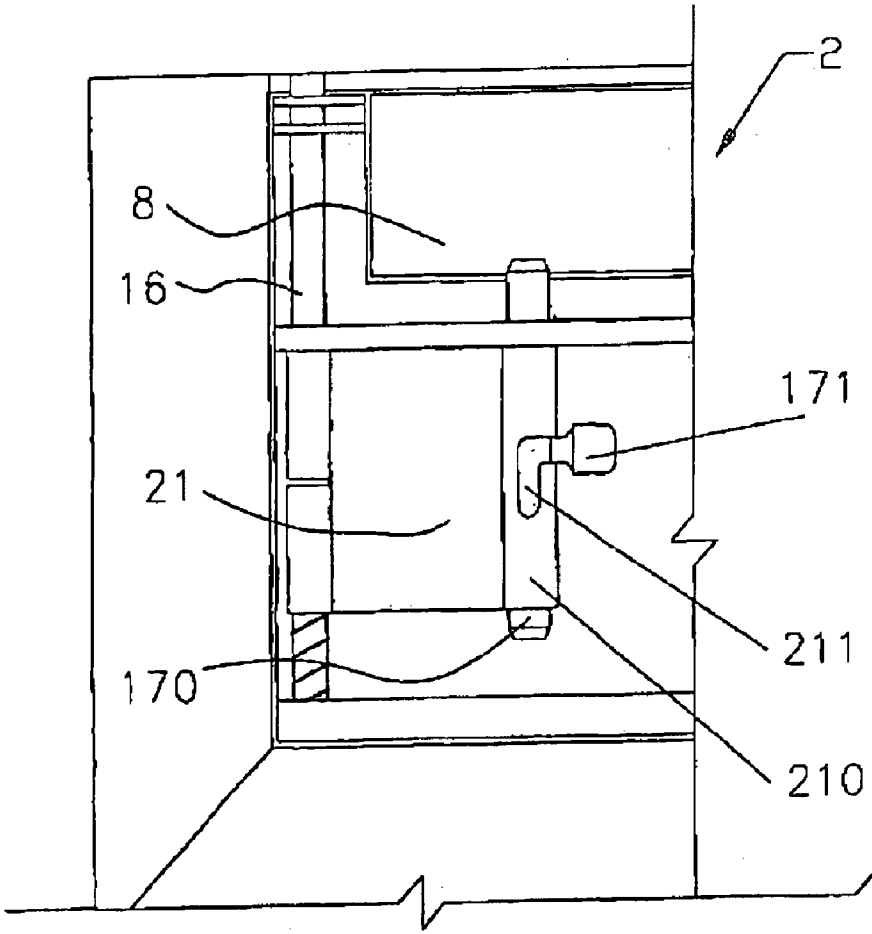
Figure 9B:
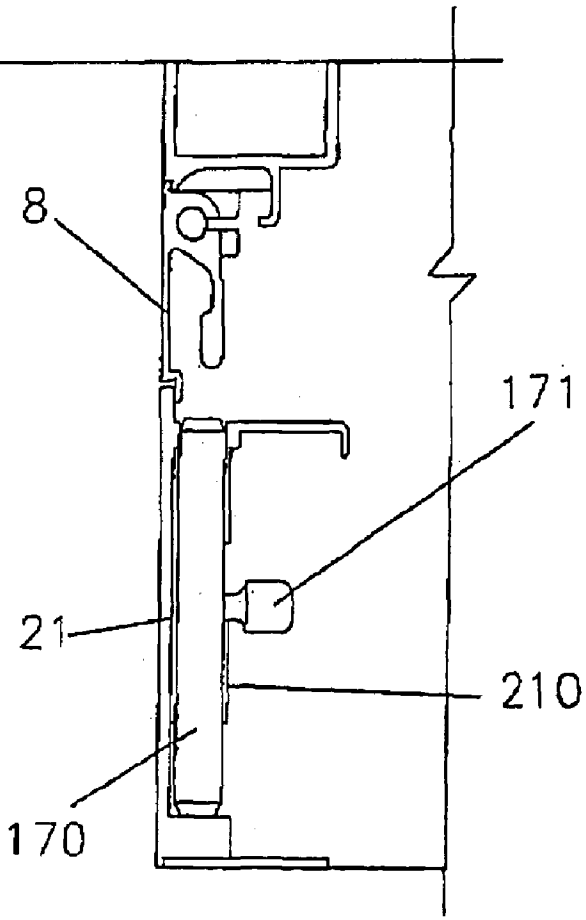
FIGS. 9A and 9B are views similar to those of FIGS. 8A and 8B but showing the modified locking member in inoperable condition.
Figure 9A:
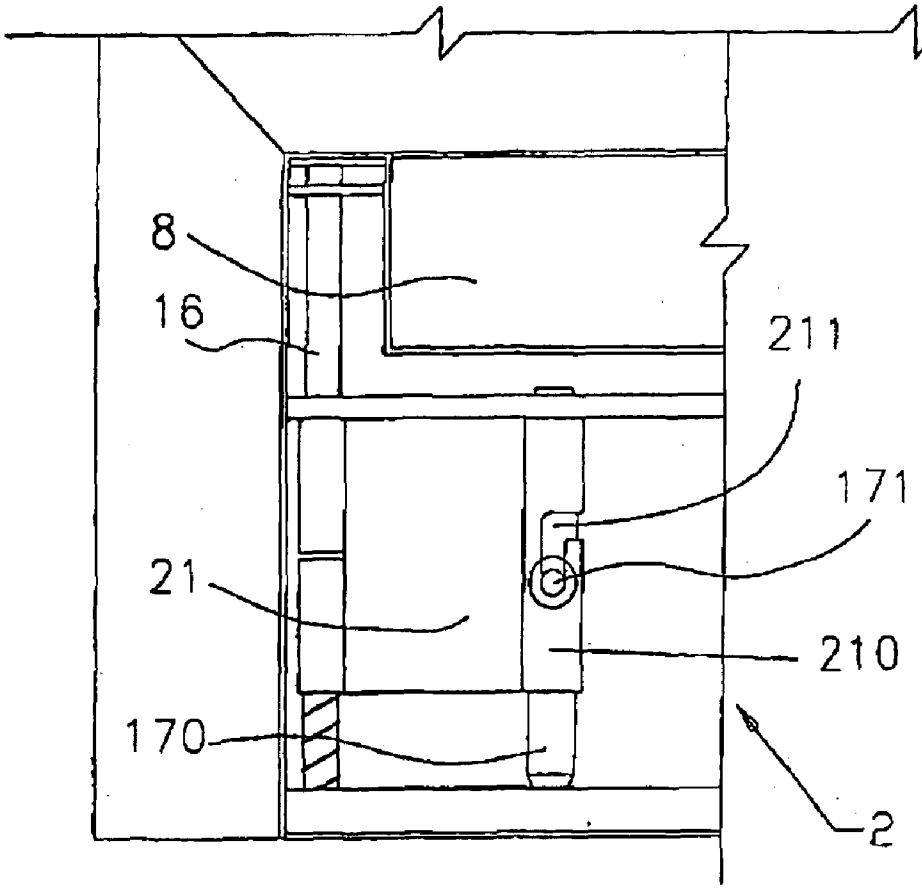

In the condition shown in FIGS. 8A and 8B, the locking finger 170 is advanced so that its upper end can interfere with the movement of the mail delivery flap 8 so as to prevent it from being opened. With the locking finger 170 in this position, the system operates as in the embodiment above-described. In the condition shown in FIGS. 9A and 9B, however, it can be seen that the locking finger 170 has been adjusted relative to the tubular portion 210 so that it is retracted from the location of the mail delivery flap 8 and cannot interfere with its movement. It is a simple matter for the user of the respective compartment to elect whether or not his mailbox should be capable of receiving junk mail or other deliverable material merely by selective adjustment of the operating member 171 and correspondingly of the position of the locking finger 170 relative to the tubular portion 210. An indication of the condition of the locking finger 170, visible from the front of the mailbox, could for example be provided by provision of sight glasses or windows (small boxes) in the compartment doors which enable coloured or other distinctive indicia provided on the fingers 170 to be observed.

Having described the present invention in the foregoing by reference to a particular embodiment and a modification thereof, it is to be appreciated that the embodiments are in all respects exemplary and that modifications and variations thereto are possible without departure from the spirit and scope of the invention as set forth in appended claims. Thus, for example, whilst the invention has been described by reference to multi-compartment mailboxes, the teaching of the invention could be applicable to other multi-compartment situations. Furthermore, the invention is applicable to retrofit applications where a master door as herein described is fitted to an already existing mailbox array. This is a significant advantage over the system of GB-A-2289500 which is not readily adaptable to retrofit applications since installation of the matrix array of orthogonal bars cannot simply be achieved by fitting the existing structure of a multicompartment mailbox with a new door. The various locks in the embodiments are key operated, but one or more or all could be replaced by corresponding combination locks and the references herein to operation of a lock by a key are intended to be interpreted accordingly.

What is claimed is:

1. A multi-compartment facility having a master door 3 to provide access to all of the compartments 2, the master door having a plurality of sub-doors 6, which register with individual compartments 2 when the master door 3 is closed and provide access only to a respective compartment, the sub-doors 6 each having delivery openings with closures 8 characterized in that at least one group of the compartments is arranged in a linear array, a hinged rod 16 traversing said array to provide for pivotal mounting of the sub-doors 6 of the compartments 2 in the array, the closures 8 being lockable by operation of a manually operable control 9 to displace said hinged rod 16 longitudinally.

2. A multi-compartment facility as claimed in claim 1 wherein the master door 3 has a lock 4 and the sub-doors 6 all have locks 7, the sub-door locks each being openable with a key which will open just that sub-door 6 and no others and will not open the master door.

3. A multi-compartment facility as claimed in claim 2 wherein the delivery openings enable material to be placed in the respective compartment 2 without the need to open the sub-door.

4. A multi-compartment facility as claimed in claim 2 wherein said closures 8 comprises pivotally mounted flaps.

5. A multi-compartment facility as claimed in claim 1 wherein the delivery openings enable material to be placed in the respective compartment 2 without the need to open the sub-door.

6. A multi-compartment facility as claimed in claim 1 wherein said closures 8 comprise pivotally mounted flaps.

7. A multi-compartment facility as claimed in claim 6 wherein said closures 8 are collectively lockable and unlockable.

8. A multi-compartment facility as claimed in claim 7 wherein the manually operable control 9 is provided for collectively determining the status, locked or unlocked, of said lockable closures 8.

9. A multi-compartment facility as claimed in claim 8 wherein said manually operable control 9 incorporates releasable locking means 25 for enabling it to be rendered selectively operable or inoperable.

10. A multi-compartment facility as claimed in claim 9 wherein the manually operable control 9 is arranged to operate locking members 17 associated individually with each of said closures 8.

11. A multi-compartment facility as claimed in claim 10 wherein said locking members 17 are selectively and individually adjustable between operable and inoperable conditions.

12. A multi-compartment facility as claimed in claim 9 wherein the manually operable control 9 comprises a gear wheel 10 which, when turned by operation of the control 9, displaces cam means cooperating with an actuator 35 arranged for displacing said hinged rod 16.

13. A multi-compartment facility as claimed in claim 12 wherein said gear wheel 10 serves to linearly displace a rack member 11, 12 having said cam means formed thereon.

14. A multi-compartment facility as claimed in claim 1 wherein a said lockable closures 8 are arranged such that when they are closed no gaps exist therearound which would admit a thin sheet of paper.

15. A multi-compartment facility as claimed in claim 1 wherein a plurality of such groups of compartments in parallel linear arrays have all closures lockable by one and the same manually operable control 9.

16. A multi-compartment facility as claimed in claim 15 wherein the peripheries of the lockable closures 8 and of the delivery openings are complementarily shaped and nest with each other when the closures are closed so that no straight line or gently curved path exists there between.

17. A multi-compartment facility as claimed in claim 1 wherein said master door 3 and/or said sub-doors 6 are arranged so that when closed no gaps exist there around which would admit a thin sheet of paper.

18. A multi-compartment facility as claimed in claim 17 wherein the peripheries of the master door 3 or the sub-doors 6 and of the openings which they serve to close are complementarily shaped and nest with each other when the respective doors; and are closed so that no straight line or gently curved path exists there between.

* * * * *